US007753301B1

(12) United States Patent
Lo

(10) Patent No.: US 7,753,301 B1
(45) Date of Patent: Jul. 13, 2010

(54) GUIDE-CUTTING PLATE OF A CUTTING WHEEL FOR A PAPER SHREDDER

(76) Inventor: Emily Lo, No. 18, 20 Lane, Hsin Feng Street, Hsin Chuang City, Taipei Shien (TW)

( * ) Notice: Subject to any disclaimer, the term of this patent is extended or adjusted under 35 U.S.C. 154(b) by 0 days.

(21) Appl. No.: 12/214,349

(22) Filed: Jun. 17, 2008

(51) Int. Cl.
*B02B 7/02* (2006.01)
*B02C 23/00* (2006.01)

(52) U.S. Cl. ..... 241/100; 241/236

(58) Field of Classification Search ..... 241/100, 241/236

See application file for complete search history.

(56) References Cited

U.S. PATENT DOCUMENTS 4,192,467 A * 3/1980 Hatanaka ..... 241/34
5,375,782 A * 12/1994 Schwelling ..... 241/166
5,829,697 A * 11/1998 Kroger ..... 241/236
5,954,280 A * 9/1999 Kroger et al. ..... 241/166
7,234,656 B1 * 6/2007 Lo ..... 241/34
2002/0100827 A1 * 8/2002 Ho ..... 241/100
2002/0195510 A1 * 12/2002 Lin ..... 241/236
2004/0140382 A1 * 7/2004 Ho ..... 241/236
2004/0262436 A1 * 12/2004 Lo ..... 241/236
2005/0161541 A1 * 7/2005 Lo ..... 241/236
2006/0038048 A1 * 2/2006 Lo ..... 241/100
2007/0215734 A1 * 9/2007 Tsai ..... 241/236

* cited by examiner

*Primary Examiner*—Bena Miller
(74) *Attorney, Agent, or Firm*—Pro-Techtor Int'l Services; Ralph Willgohs

(57) ABSTRACT

A guide-cutting sheet of a cutting wheel for a paper shredder is characterized in that two sides of a centerline of a planar linear guide-cutting sheet are opened respectively with blade shaft transfix holes corresponding to a spacing between the blade shafts of two parallel cylindrical rotary cutting wheels; below or above two blade shaft transfix holes are opened respectively with fixing rod transfix holes, corresponding to a spacing between two fixing rods; the centerline part above two blade shaft transfix holes is opened with a rabbet which can be latched at two aperture walls of a strip-shape aperture on a face cover; and a bottom of the rabbet is provided with a concaved knife-edge which can cut off paper sheets.

5 Claims, 4 Drawing Sheets

GUIDE-CUTTING PLATE OF A CUTTING WHEEL FOR A PAPER SHREDDER

BACKGROUND OF THE INVENTION a) Field of the Invention

The present invention relates to a guide-cutting sheet of a cutting wheel for a paper shredder b) Description of the Prior Art Cutting wheels of an ordinary paper shredder are constituted by two cylindrical rotary cutting wheels that rotate in opposite directions (clockwise and counterclockwise); whereas, the cylindrical rotary cutting wheel is assembled by a blade shaft and a plurality of blades that are sheathed on the blade shaft and are separated with each other with a gasket. The two cylindrical rotary cutting wheels are placed side by side, and installed parallel on a blade rack, with every blade, which is aligned on one of the two cylindrical cutting wheels, being intersected with each other to form a plurality of cut-openings. As the rotary cutting wheels should bear with certain pressure when shredding paper sheets that are fed in, a certain requirement for intensity and rigidity of the two cutting wheels is available. Otherwise, when the paper shredder operates in high speed to shred the paper sheets, the two cylindrical rotary cutting wheels will be pushed open against each other if too many paper sheets are rolled into the cut-openings of the rotary cutting wheels. This push-open phenomenon will not only enable the blades of the cylindrical rotary cutting wheels to be fractured very easily, such that a shredding effect of the paper shredder will be affected; but also will affect a normal operation of the paper shredder in a severe condition. On the other hand, during the paper shredding operation, an operator feeds the paper sheets that need to be shredded into the paper shredder from a strip-shape aperture on a face cover of the paper shredder, allowing the cutting wheels that are operating in high speed inside the paper shredder to cut and smash the paper sheets that have been fed in. However, the strip-shape aperture on the face cover of the paper shredder will be pushed open when too many paper sheets are fed in; and if the strip-shape aperture is pushed open excessively, a more significant safety concern will be formed and a safety regulation cannot be satisfied either. Accordingly, the normal operation of the paper shredder will all be affected when the cutting wheels are pushed open, and the strip-shape aperture on the face cover of the paper shredder is widely pushed open.

SUMMARY OF THE INVENTION

Accordingly, the primary object of the present invention is to provide a guide-cutting plate for a cutting wheel for a paper shredder, which is able to overcome a push-open phenomenon that may occur when too many paper sheets are rolled into cut-openings of rotary cutting wheels, thereby facilitating a normal operation of the paper shredder and improving a paper shredding effect. In addition, through a rabbet of a guide-cutting plate to latch two side walls of a strip-shape aperture on a face cover, a phenomenon that the strip-shape aperture is pushed open by feeding into too many paper sheets can be prevented, thereby satisfying a safety regulation and largely improving safety of operation.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 3:
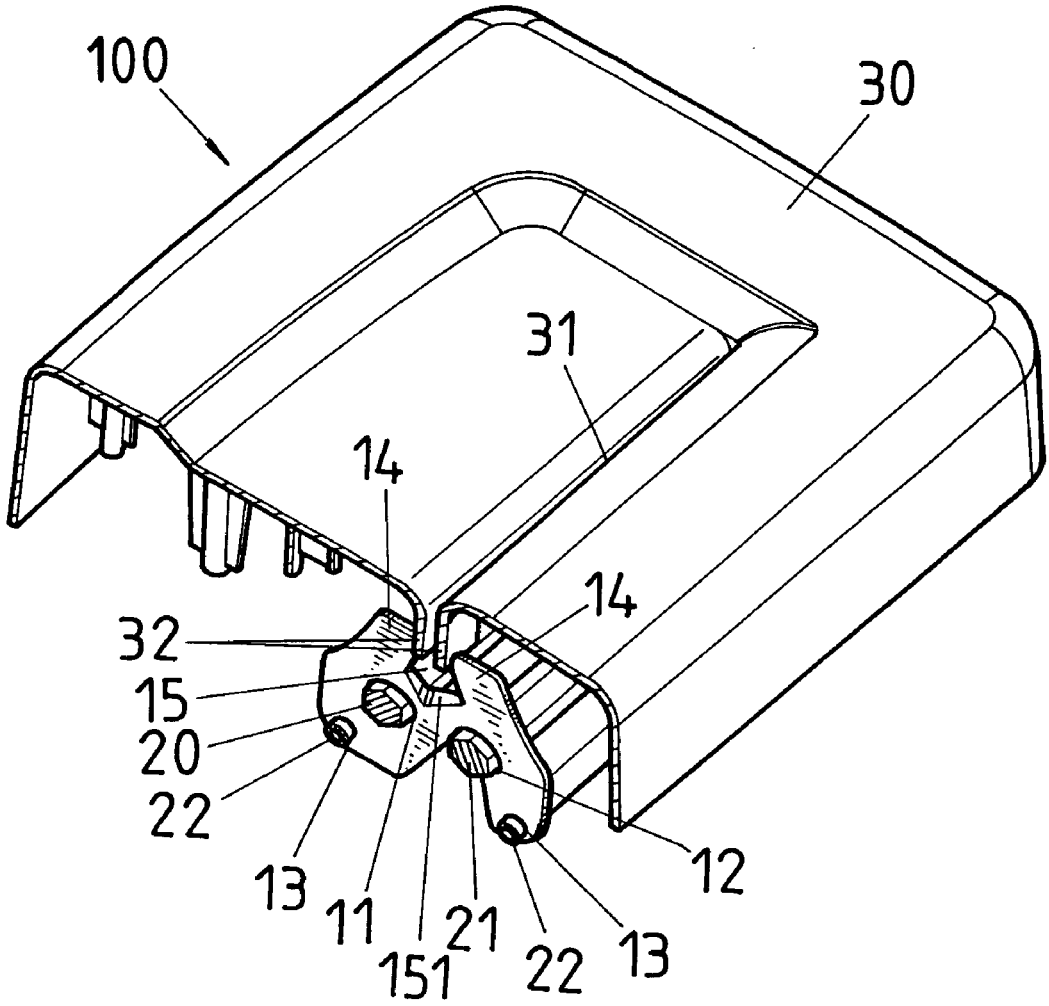
FIG. 3 shows a schematic view of a fitting relation between a guide-cutting sheet and a face cover of the present invention.

As shown in FIG. 3, a metallic guide-cutting plate 10 is mounted on a paper shredder head having two parallel cylindrical rotary cutting wheels on blade shafts 20,21 and two fixing rods 22 positioned in proximity of said blade shafts 20,21 with a shredder cover 30 having a longitudinal strip-shape aperture above a centerline (or nip, see FIG. 4) of the two parallel cylindrical rotary cutting wheels installed on the blade shafts 20,21.

Figure 1:
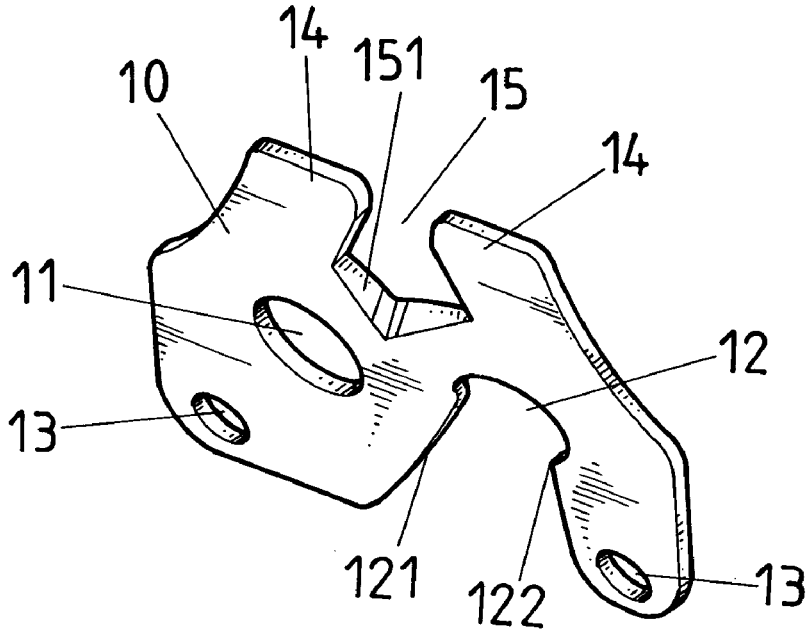
FIG. 1 is a perspective view of the present invention.
Figure 2:
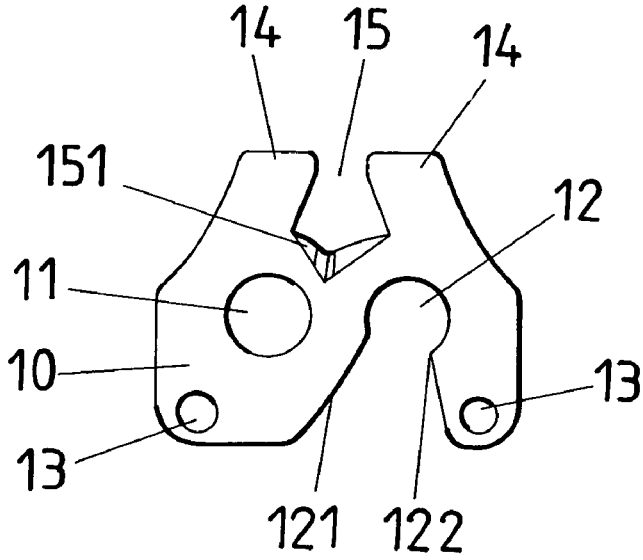
FIG. 2 is a plan schematic view of the present invention.

Referring to FIG. 1 and FIG. 2, on two sides of a centerline of a metallic guide-cutting plate 10 are opened respectively with blade shaft transfix holes 11, 12 corresponding to a spacing of blade shafts of two parallel cylindrical rotary cutting wheels, and an opening end of one blade shaft transfix hole 12 is a blade shaft latch-in mouth 121, with a neck part 122 at a middle section; below the two blade shaft transfix holes 11,12 respectively, the guide-cutting plate 10 is opened with fixing rod transfix holes 13 corresponding to a spacing between the two fixing rods; the centerline part above the two blade shaft transfix holes 11, 12 is opened with a rabbet 15 which can be latched on two side walls of a strip-shape aperture on a face cover 30 by the ears 14, and a bottom of the rabbet 15 is provided with a V-shape knife-edge 151 cut on a single-direction oblique sliding surface, with an apex of the V-shape at a side slightly offset to the centerline as shown in FIG. 2, such that vertical force exerted by paper sheets to the knife-edge 151 can be reduced, allowing residue that is cut off to be guided to a side of the knife-edge 15, and enabling residual debris to totally fall out toward the lowest part in a middle of the blade shaft.

Figure 4:
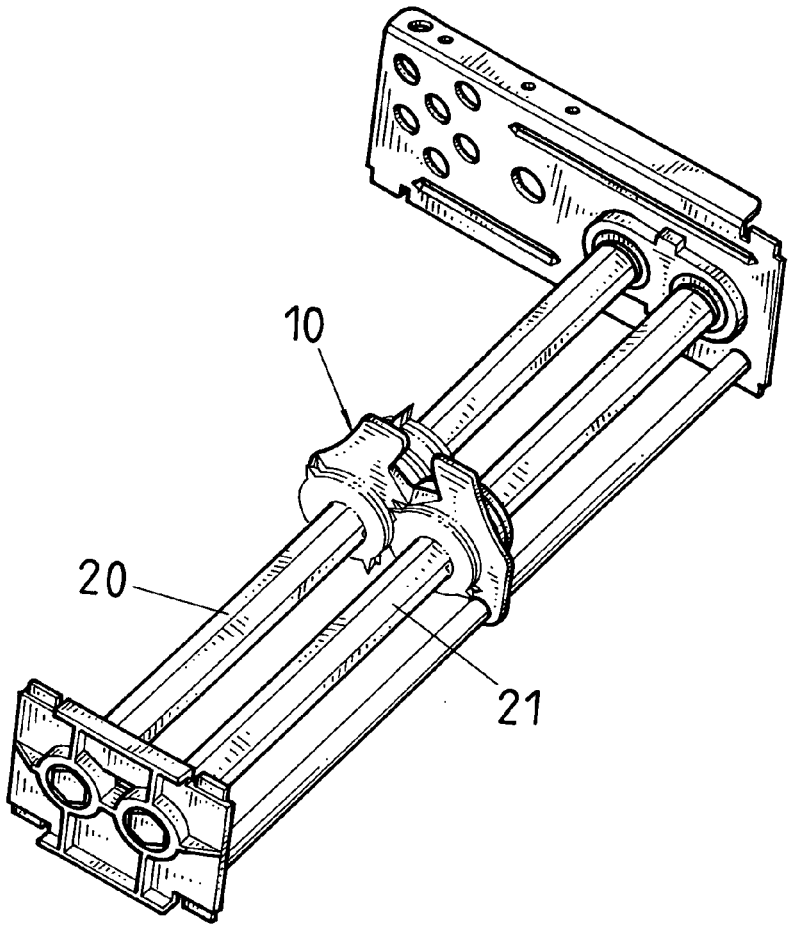
FIG. 4 is a schematic view of structure wherein a guide-cutting sheet is installed on a blade shaft, in accordance with the present invention.
Figure 5:
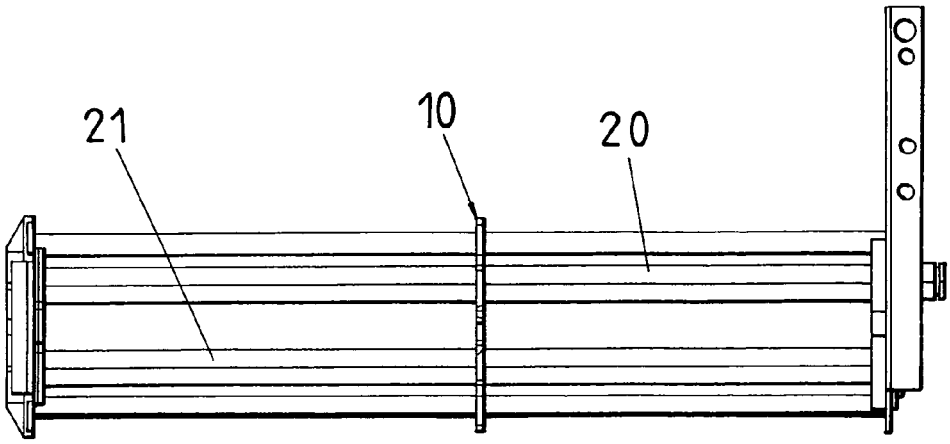
FIG. 5 is a plan schematic view that a guide-cutting sheet is installed on a blade shaft, in accordance with the present invention.

Referring to FIG. 3, it shows a schematic view of a fitting relation between the guide-cutting plate 10 and the face cover 30. Using the blade shaft transfix holes 11, 12 on the guide-cutting plate 10, the guide-cutting plate 10 is installed at a middle section of two blade shafts 20, 21 of cylindrical rotary cutting wheels 20, 21 (as shown in FIG. 4 and FIG. 5), and the two blade shafts 20,21 are connected as one unit through the planar linear guide-cutting plate 10. The fixing rod transfix hole 13 is then transfixed with a fixing rod 22 to install the cutting wheels assembled by two cylindrical rotary cutting wheels on a blade rack in a bottom case (not shown in the drawings). Next, the face cover 30 which is provided with a strip-shape aperture 31 is engaged on the bottom case (not shown in the drawings), followed by latching exterior sides of two aperture walls 32 in the strip-shape aperture 31 on the face cover 30 between the ears 14 of the rabbet 15 of the guide-cutting plate 10, to secure the aperture walls 32 of the strip-shape aperture 31 on the face cover 30.

Figure 6:
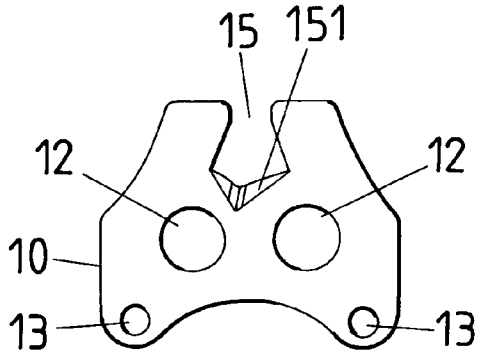
FIG. 6 is a plan schematic view in accordance with a second embodiment of the present invention.
Figure 7:
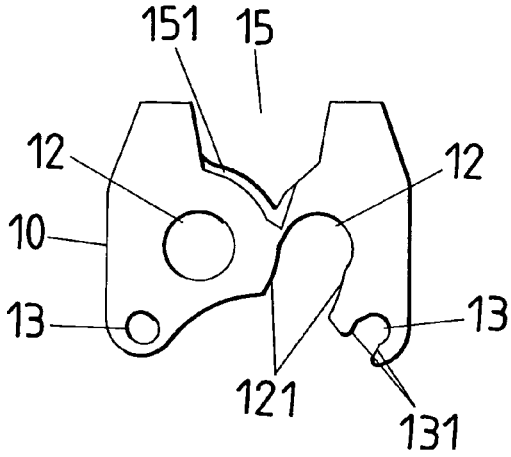
FIG. 7 is a plan schematic view in accordance with a third embodiment of the present invention.
Figure 8:
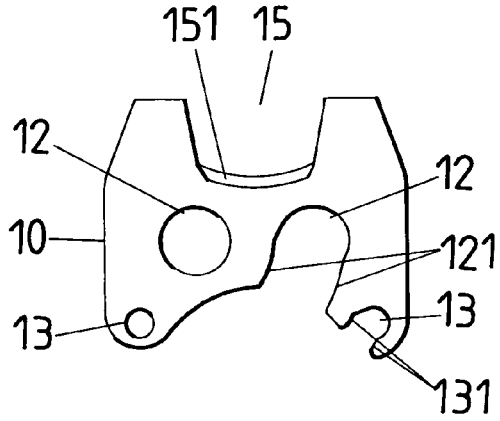
FIG. 8 is a plan schematic view in accordance with a fourth embodiment of the present invention.
Figure 9:
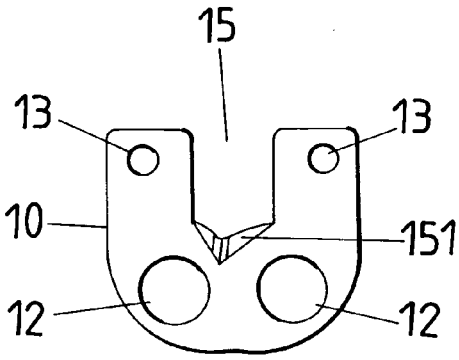
FIG. 9 is a plan schematic view in accordance with a fifth embodiment of the present invention.
Figure 10:
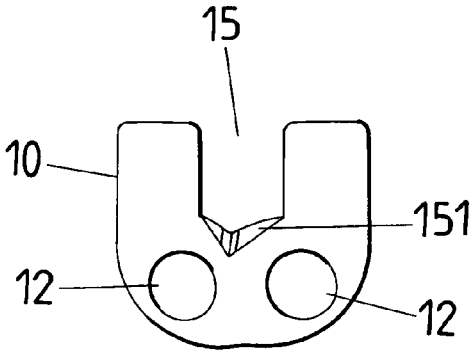
FIG. 10 is a plan schematic view in accordance with a sixth embodiment of the present invention.

Referring to FIGS. 6 to 10, it shows a schematic view of other embodiment of the present invention. As shown in FIG. 6, the guide-cutting plate 10 is provided with two blade shaft transfix holes 12; as shown in FIG. 7, a bottom of the guide-cutting plate 10 is opened respectively with a blade shaft latch-in mouth 121 for latching in the blade shaft in a radial direction, and a fixing rod latch-in mouth 131 for latching in the fixing rod in a radial direction; as shown in FIG. 8, a bottom of the rabbet 15 of the guide-cutting plate 10 is provided with a U-shape knife-edge 151; as shown in FIG. 9, the fixing rod transfix hole 13 of the guide-cutting plate 10 is located above the blade shaft transfix hole 12; and as shown in FIG. 10, there is no fixing rod transfix hole on the guide-cutting plate 10.

In installing the guide-cutting plate 10, the guide cutting plate 10 can be pre-installed on the blade shaft 20 of one cylindrical rotary cutting wheel by transfixing, and then while fitting the cutting wheels with the blade rack, the blade shaft latch-in mouth 121 and the fixing rod latch-in mouth 131 are used to latch the blade shaft 21 of another cylindrical rotary cutting wheel in a radial direction into the blade shaft transfix hole 11 and the fixing rod transfix hole 13 at the other side of the guide-cutting plate 10, which facilitates installing the guide-cutting plate 10 on the cylindrical rotary cutting wheels.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A guide-cutting plate of a cutting wheel for a paper shredder cutting head with cylindrical rotary cutting wheels on two parallel blade shafts with two fixing rods in proximity to said blade shafts and a shredder cover with a longitudinal strip-shape aperture above a centerline of said blade shafts, comprising: a planar linear guide-cutting plate having blade shaft transfix holes, opened on two sides of a centerline thereof, corresponding to a spacing between said blade shafts of said two parallel cylindrical rotary cutting wheels; said guide-cutting plate being opened with two fixing rod transfix holes corresponding to a spacing between two fixing rods; a centerline part above the two blade shaft transfix holes being opened with a rabbet which is latched on two sidewalls of the strip-shape aperture in the shredder cover; and a bottom of the rabbet being provided with a concaved knife-edge to cut off a residue of paper sheets.

2. The guide-cutting plate of a cutting wheel for a paper shredder cutting head with cylindrical rotary cutting wheels on two parallel blade shafts with two fixing rods in proximity to said blade shafts and a shredder cover with a longitudinal strip-shape aperture above a centerline of said blade shafts, according to claim 1, wherein a side of the centerline of the guide-cutting plate is provided respectively with a blade shaft latch-in mouth latching the guide-cutting plate on the blade shaft in a radial direction, and a fixing rod latch-in mouth for latching in the fixing rod in a radial direction.

3. The guide-cutting plate of a cutting wheel for a paper shredder cutting head with cylindrical rotary cutting wheels on two parallel blade shafts with two fixing rods in proximity to said blade shafts and a shredder cover with a longitudinal strip-shape aperture above a centerline of said blade shafts, according to claim 1, wherein the knife-edge of the rabbet is a concaved knife-edge on a single-direction oblique sliding surface.

4. The guide-cutting plate of a cutting wheel for a paper shredder cutting head with cylindrical rotary cutting wheels on two parallel blade shafts with two fixing rods in proximity to said blade shafts and a shredder cover with a longitudinal strip-shape aperture above a centerline of said blade shafts, according to claim 1, wherein a bottom of the rabbet is a V-shape knife-edge.

5. The guide-cutting plate of a cutting wheel for a paper shredder cutting head with cylindrical rotary cutting wheels on two parallel blade shafts with two fixing rods in proximity to said blade shafts and a shredder cover with a longitudinal strip-shape aperture above a centerline of said blade shafts, according to claim 1, wherein a bottom of the rabbet is a U-shape knife-edge.

* * * * *